United States Patent [19]

Komatsu

[11] Patent Number: 4,506,379

[45] Date of Patent: Mar. 19, 1985

[54] METHOD AND SYSTEM FOR DISCRIMINATING HUMAN VOICE SIGNAL

[75] Inventor: Akira Komatsu, Tokyo, Japan

[73] Assignee: Bodysonic Kabushiki Kaisha, Tokyo, Japan

[21] Appl. No.: 541,483

[22] Filed: Oct. 13, 1983

Related U.S. Application Data

[63] Continuation of Ser. No. 251,333, Apr. 6, 1981, abandoned.

[30] Foreign Application Priority Data

Apr. 21, 1980 [JP] Japan ..... 55-54290
Apr. 21, 1980 [JP] Japan ..... 55-52682

[51] Int. Cl.[3] ..... G10L 1/00

[52] U.S. Cl. ..... 381/46; 381/61; 381/68; 381/73; 381/87

[58] Field of Search ..... 381/46, 61, 73, 68, 381/87; 370/81; 455/221, 245

[56] References Cited

U.S. PATENT DOCUMENTS

| | | | |
|---|---|---|---|
| 4,027,102 | 5/1977 | Ando et al. | 381/46 |
| 4,158,749 | 6/1979 | Deman et al. | 179/1.5 C |
| 4,222,394 | 9/1980 | Nagashima et al. | 179/1.5 C |
| 4,331,837 | 5/1982 | Soumagne | 179/1.5 C |
| 4,359,604 | 11/1982 | Dumont | 381/46 |

*Primary Examiner*—E. S. Matt Kemeny
*Attorney, Agent, or Firm*—Parkhurst & Oliff

[57] ABSTRACT

Audible entertainment signals are also filtered to detect speech presence whereby only frequencies in the band 0–150 Hz, are applied to vibrate a listener's chair for special effects.

10 Claims, 7 Drawing Figures

METHOD AND SYSTEM FOR DISCRIMINATING HUMAN VOICE SIGNAL

This is a continuation of application Ser. No. 251,333, filed Apr. 6, 1981, now abandoned.

BACKGROUND OF THE INVENTION

This invention relates to a method for discriminating a human voice signal from any other sound signal, and also to a system for the method.

In the living environments of human beings, various sounds are existent. In recording and reproducing the sounds, it is required to record and reproduce them at high sensitivity and at high fidelity. In general, satisfying these requirements suffices.

In such general cases, all the sounds having entered, for example, a microphone have only to be equally amplified and reproduced. In some special uses, however, it becomes necessary to classify input signals depending on their properties or types and to subject a certain type of signals to processings different from those of the other types of signals.

This is, for example, to derive human voices from among noise or to pick up only the voices of an announcer separately from the other sounds such as music in case of recording the sounds of a radio or television broadcast. It is further considered to apply the above technique to devices for applying vibrations to the human body (body-felt vibration generator etc.) which have recently been proposed and put into practical use. Body-felt vibration is intended to mean a vibration which is felt by the human body due to the acoustic energy of a low sound frequency range component of sound; namely, a mechanical vibration produced from the acoustic energy by an acoustic energy-mechanical vibration converting system which applies the mechanical energy to the human body.

The body-felt vibration generator is a device in which, in order to give rise to the ambience with a sound reproducing equipment, signals of double (low) bass sound components of, e.g., below 150 Hz among amplifier output signals to be applied to loudspeakers (or headphones) are converted into mechanical vibrations so as to directly give the latter to the human body as body-felt vibrations, and the sounds and the body-felt vibrations of the double bass sound region are simultaneously given to an appreciator (a listener of music), thereby to intensify a heavy double bass sound feeling. The device has achieved effects principally for the appreciation of music.

It has been experimentally confirmed that, when the device is combined with sounds other than music, for example, documentary sounds and effect sounds attended with an earth tremor or the feeling of a shock such as the roaring of a gun, the running sound of a street car or steam locomotive, noise emitted when a big tree is cut down, explosion, and the running sounds and engine sounds of an automobile, tractor etc., the ambience and dramatic effects which cannot be obtained with conventional sound reproducing equipment can be brought forth.

When such device is incorporated into the cinema, television or the like, the real presence and numerous dramatic effects will be obtained. In this regard, a film drama, a television drama or the like is, in general, composed of the combination of human voices (conversation), music, and effect sounds.

Accordingly, when such sound signals are given to the appreciator in the form of the body-felt vibrations without performing any additional processing, big effects can be expected as to the sounds attended with the earth tremor and the feeling of a shock, while the body-felt vibrations are also produced as to the human voices (conversation). This has been experimentally revealed to cause a very unnatural feeling.

In order to produce good effects in the film drama, the television drama or the like, therefore, the advent of a device which is responsive to the musical and effect sounds but is not responsive to the human voices is desired.

SUMMARY OF THE INVENTION

Main object of this invention is to provide a method and system for discriminating a human voice signal as produce favorable results when applied to various uses as in appreciation of a film-drama, a television drama or the like.

A method according to this invention consists in that a fundamental wave component in the human voice as produced by a vocal-cords sound source is emphatically derived, thereby to discriminate the human voice from other sound.

The production and features of the human voice will now be considered. When the vocal cords vibrate to open and close the trachea at the natural frequency thereof, periodic pulsating pressure waves are generated at the vocal cords. It is known that the pressure waves are pulse waves near saw-tooth waves whose fundamental wave component is approximately one hundred and tens and which vary in a considerably wide range, in case of the voice of a grown-up man during the ordinary conversation. (Hereinafter "pulse wave" is referred to as "saw-tooth wave"). The saw-tooth waves of the vocal-cords sound source are given complicated formants such as resonance and antiresonance while propagating through the vocal tube consisting of the pharynx, oral cavity, nasal cavity etc., and they are emitted from the lips into the voice. (In general, the resonance frequencies are distributed at frequencies considerably higher than the fundamental wave frequency of the saw-tooth waves of the vocal-cords sound source).

These are schematically illustrated in FIGS. 2(*a*) to 2(*c*). FIG. 2(*a*) shows the saw-tooth wave of the vocal-cords sound source, while FIG. 2(*b*) shows the voice waveform given the formants in the vocal tube. The saw-tooth waves produced at the vocal cords include higher harmonics abundantly, and hence, when they are given formants in the resonance circuit part of the vocal tube, they become as shown in FIG. 2(*b*).

As seen from this figure, the fundamental wave component decreases, and the formant frequency components increase considerably.

On the other hand, in general, when the saw-tooth waves are amplitude-modulated by a carrier waves, a waveform as shown in FIG. 2(*c*) is obtained. When FIGS. 2(*b*) and 2(*c*) are compared, it will be seen that although the processes of production of the waveforms are quite different, both these waveforms are very similar macroscopically.

Therefore, when the voice waveform in FIG. 2(*b*) is regarded as a kind of amplitude-modulated wave, the detection thereof permits to readily and emphatically derive the fundamental wave component of the vocal-cords sound source. This is the fundamental principle of this invention.

A system according to this invention consists in that a double-bass sound region deriving circuit which derives the component the double bass frequencies of which are lower than those of the fundamental wave components of the human voice of the signals applied into an input terminal is connected to an input terminal of control means such as, for example, a voltage-controlled variable gain amplifier whose gain varies in correspondence with a voltage applied to its control terminal, and that the control means is controlled with an output of the double bass region deriving circuit, whereby a sound accompanied by shock feeling such as earth tremor including components of and below approximately 60 Hz abundantly and a human voice scarcely including the components are discriminated.

Further, a system according to this invention consists in that an input level deriving circuit which rectifies an input signal and integrates or smooths the rectified signal to provide a direct current proportional to an input signal level, and a human-voice fundamental wave emphasizing and deriving circuit which emphatically derives a fundamental wave component of a vocal-cords sound source from the input signal are connected to the input terminal of the control means; that an output terminal of said input level deriving circuit and an output terminal of said human-voice fundamental wave emphasizing and deriving circuit are connected to an arithmetic circuit which operates an output of said human-voice fundamental wave emphasizing and deriving circuit and an output of said input level deriving circuit; and that an output terminal of said arithmetic circuit is connected to the control terminal of said control means; whereby whether the input signal is the human voice or any other sound can be discriminated by comparing relatively to each other the whole level of the input signal and the fundamental wave component of the vocal-cords sound source emphatically derived from within the input signal.

DETAILED DESCRIPTION OF THE PREFERRED EMBODIMENTS

Figure 1:
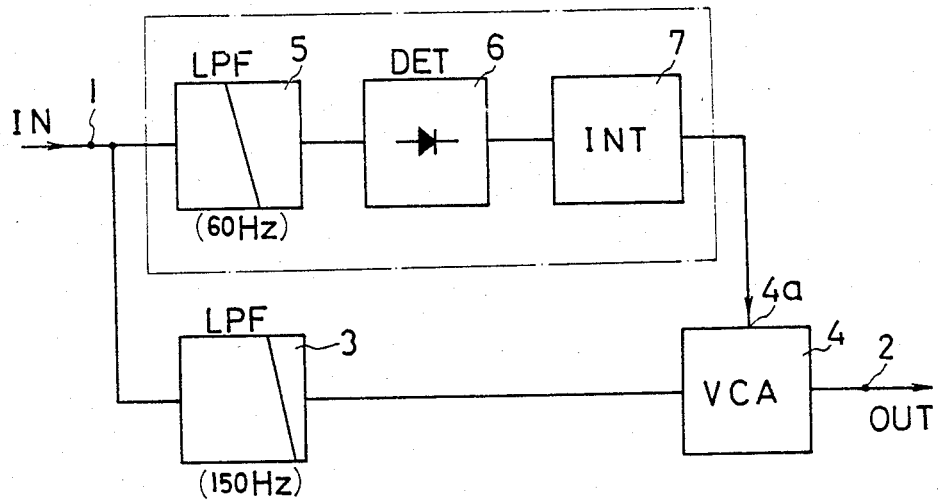
FIG. 1 is an example of a block diagram for performing a method of this invention, FIGS. 2(*a*) to 2(*d*) are waveform diagrams schematically showing the waveforms of a human voice and sounds of music etc.

Hereunder, this invention will be illustratively described in conjunction with a body-felt vibration generator which is one example of application thereof. When the frequency components of human voices, music, effect sounds etc. are studied, the low region of the human voices (chiefly, male voice) extends even to below 80 Hz and the high region extends to above 10 kHz in both the male and female voices though they are also dependent upon recording circumstances and individual differences.

The effect sounds are of a very large number of sorts, and have various frequency spectra. An earth tremor or such a sound as causing the feeling of a shock is characterized by including a wide frequency distribution and abundant double-bass sound components. The musical sounds often have a frequency distribution which is uniform and wide as compared with those of the other sounds.

In view of these facts, it might be a measure to distinguish the human voices and the other sounds by passing them through an appropriate filter. However, a low-pass filter which can cut the double bass sound fundamental wave component of the human voices extending even to below 80 Hz as stated before needs to have its cutoff frequency set at 60 Hz or below, which poses a problem. More specifically, among frequency component below approximately 150 Hz which are effective as body-felt vibrations, the frequency component density is the highest at spectra near 100 Hz, and the distribution density at and below 50–60 Hz lowers. Therefore, the signals having been passed through the aforecited low-pass filter have most of the components effective for the body-felt vibrations cut, and the effect of the body-felt vibration generator is drastically spoiled.

Since the sound as is attended with the earth tremor includes also double-bass sound components of and below 60 Hz sufficiently, it can give rise to the body-felt vibrations. Without the components near 100 Hz, however, a real feeling is lessened, and flat vibrations of unvivid feeling are caused. This situation is just likened to the sound of a loudspeaker from which a tweeter has been detached so that it cannot give forth high-pitched sounds.

FIG. 1 shows an example of a circuit which has eliminated such problem. Referring to the figure, numeral 1 designates an input terminal, which receives a sound signal from an amplifier. A first low-pass filter 3 having a cutoff frequency of approximately 150 Hz and a voltage-controlled variable gain amplifier (VCA) 4 are connected between the input terminal 1 and an output terminal 2.

The low-pass filter 3 serves to derive from its input signal the double-bass sound component below approximately 150 Hz convenient for the body-felt vibration and to supply the derived component to the body-felt vibration generator. The voltage-controlled variable gain amplifier 4 is an amplifier whose gain increases or decreases upon application of a voltage to a control end 4*a* thereof. In the present example, an amplifier whose gain increases with an applied positive voltage is employed.

Further connected to the input terminal 1 is the input side of a second low-pass filter 5 having a cutoff frequency of approximately 60 Hz. The output side of the second low-pass filter 5 is connected to the control end 4*a* of the voltage-controlled variable gain amplifier 4 through a rectifier circuit 6 as well as an integration circuit 7.

In this circuit, when such an effect sound as is attended with the earth tremor including double bass sound components of and below 60 Hz abundantly has entered the input terminal 1 as the input sound signal, both the two low-pass filters pass the double bass sound components of the signal. An output signal of the second low-pass filter 5 is rectified by the rectifier circuit 6, and is thereafter integrated by the integration circuit 7.

An output voltage of the integration circuit 7 is applied to the control terminal 4a of the voltage-controlled variable gain amplifier 4, and increases the gain of this amplifier. Thus, the double bass sound component signal having passed through the first low-pass filter 3 is amplified to be great and is delivered to the output terminal 2. Accordingly, when the body-felt vibration generator is connected to the output terminal 2 in advance, an appreciator can obtain the body-felt vibration. Since the output signal includes frequency components near 100 Hz, a real vibration can be afforded.

Now, there will be described a case where a human voice signal has entered as the input signal. Since the human voice signal scarcely includes the double bass sound components of and below 60 Hz, any double bass sound component does not pass through the second low-pass filter 5, so that the output voltage of the integration circuit 7 diminishes. Therefore, the gain of the voltage-controlled variable gain amplifier 4 decreases, the signal having passed through the low-pass filter 3 is scarcely amplified, and the output signal at the output terminal 2 becomes zero or very small. Accordingly, the human voice hardly gives rise to the body-felt vibration.

Even with this circuit, the intended purpose is tentatively achieved. However, among the musical and effect sounds desired to generate the body-felt vibrations, there are a good many that do not include the components of and below 60 Hz or that include them only a little. Therefore, the apparatus of FIG. 1 which cannot generate the body-felt vibration when the component of and below 60 Hz does not exist is not always satisfactory.

Figure 3:
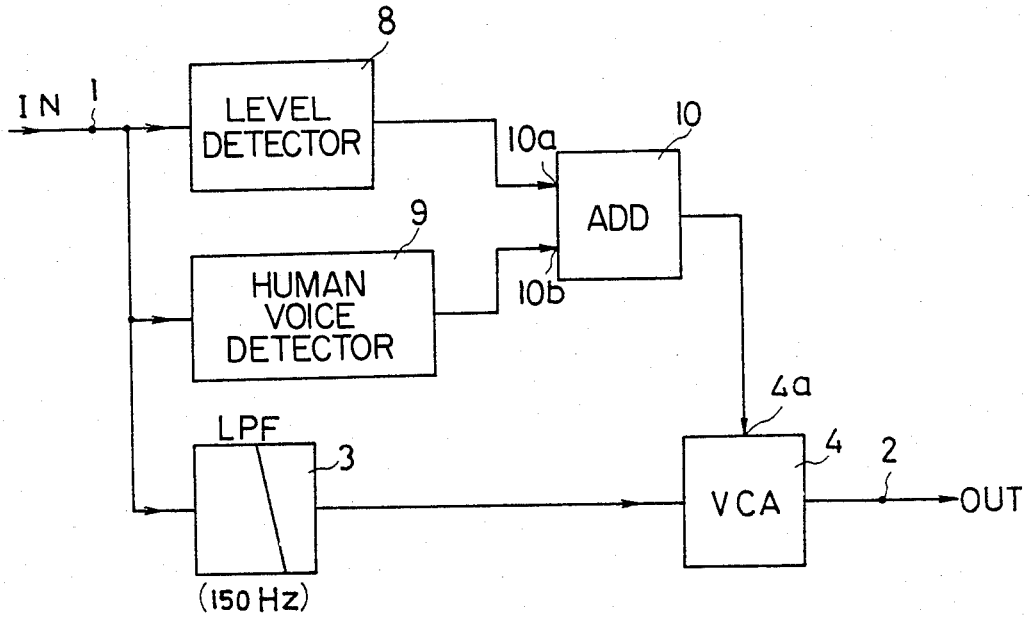
FIG. 3 is an example of a block diagram for performing the method of this invention still better.

FIG. 3 is a block diagram of an apparatus according to this invention having solved the problem. This apparatus is to emphasize and deriving a fundamental wave component generated by the sound source of vocal cords, and then comparing it with the total input signal level, thereby to discriminate the human voice from other sound.

The apparatus is constructed of an input level deriving circuit 8, a human-voice fundamental wave emphasizing and deriving circuit 9, a arithmetic circuit 10, and the low-pass filter 3 and the voltage-controlled variable gain amplifier 4 described before.

First, the human-voice fundamental wave emphasizing and deriving circuit 9 will be described in detail. Basically, this circuit is a detector circuit. It will be explained in conjunction with a simple circuit shown in FIG. 4. The circuit of FIG. 4 consists of a detector 11 and a band-pass filter 12 for selecting 80–300 Hz. According to the circuit, the fundamental wave component of the vocal-cords sound source can be derived.

Figure 2A:
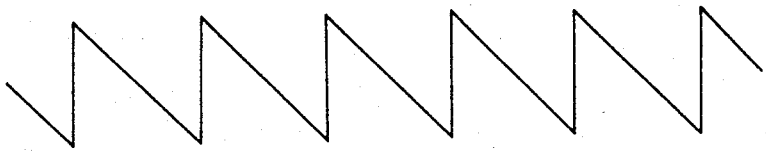
Figure 2B:
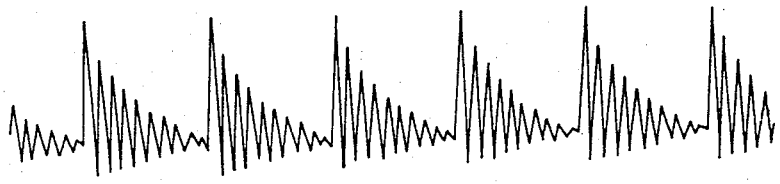
Figure 2C:
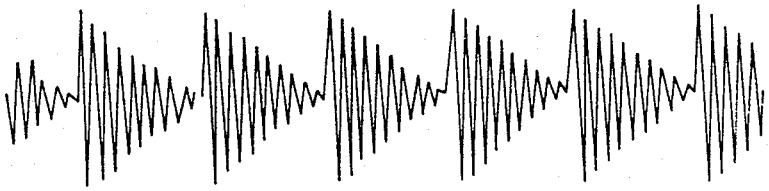
Figure 2D:
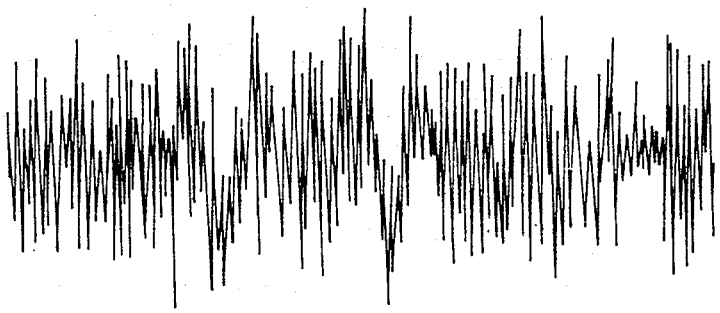

On the other hand, a waveform of a sound other than the human voice, for example, the waveform of a musical sound is as shown in FIG. 2(d). The signal of this sort has a wide frequency spectrum from a low region to a high region as shown in the figure. When this signal is detected and passed through the band-pass filter by means of the circuit in FIG. 4, an output provided at an output terminal thereof is not very great. This is attributed to the facts that since the original waveform has the wide frequency range, the percentage of the signal component to pass through the band-pass filter 12 relative to the input signal is small when the original signal is detected and passed through the band-pass filter 12, and that the waveform is not a definite shape which can be deemed an amplitude-modulated wave as shown in FIG. 2(b).

Figure 4:
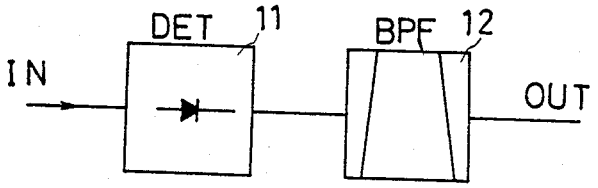
FIG. 4 is a block diagram showing a detector circuit which forms the fundamental of a human-voice fundamental wave emphasizing and deriving circuit in FIG. 3, FIGS. 5 and 6 are block diagrams each showing a detector circuit used in practice.

Accordingly, when the input signal and output signal of the circuit of FIG. 4 are respectively rectified, appropriately weighted and are compared and calculated, it becomes possible to distinguish the human voice and other sounds. That is, in case where an input signal of fixed level is applied to the circuit of FIG. 4, the signal whose output level is outputted relatively high is regarded as the human voice, and the signal whose output level is outputted relatively low is regarded as the other sound.

Since a waveform given the formants is not a simple sinusoidal wave as in a carrier wave shown in FIG. 2(c), the human voice waveform shown in FIG. 2(b) does not become a vertically symmetric form as in the amplitude-modulated wave of FIG. 2(c) but becomes a vertically asymmetric form as in FIG. 2(b) in many cases. For this reason, in case of detecting the input signal with the circuit of FIG. 4, the solution of the calculation becomes greatly different depending upon whether an envelope on the positive side or an envelope on the negative side is taken.

In case of the waveform in FIG. 2(b), it is apparent that the distinguishability is enhanced with the envelope on the positive side because the output level at the output terminal in FIG. 4 becomes higher therewith. Although the waveform shown in FIG. 2(b) has high peaks on the positive side, actually there is the inverse case where high peaks exist on the negative side. Therefore, the detector 11 in FIG. 4 needs to derive the envelope of higher level on either the positive or negative side or to derive the envelopes on both the positive and negative sides as added.

In order to fulfill this condition, the detection circuit may be made the full-wave rectification type. Since, however, the full-wave rectifier circuit is a kind of frequency multiplier circuit when viewed in point of the frequency, the input frequency is doubled. Let it now be supposed that the detection circuit 11 is the full-wave rectification type in the circuit of FIG. 4 and that a sinusoidal wave of 50 Hz has entered the input thereof. Then, a pulsating waveform having a fundamental wave component of 100 Hz (doubled frequency) appears at the detection output, with the result that an output comes out through the band-pass filter 12 having the pass band of 80–300 Hz. Therefore, when the double bass sound attended with the music or the earth tremor has entered, its frequency is multiplied to provide a derived output, resulting in the drawback that the distinguishability is lowered.

Figure 5:
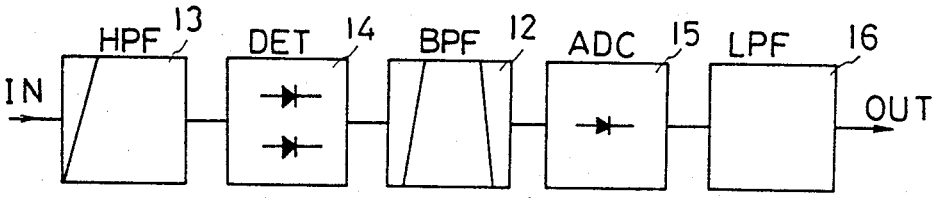

In order to eliminate such drawback, a circuit shown in FIG. 5 disposes a high-pass filter (low-cut filter) 13 which cuts the double bass sound region not being very important for the discrimination of the human voice. Even when the succeeding detection circuit 14 of the full-wave rectification type performs the frequency multiplication, the component to pass through the band-pass filter 12 lessens. According to the result of an experiment, it was suitable to set the cutoff frequency of the high-pass filter 13 at approximately 130 Hz.

The output of the band-pass filter 12 is rectified by the succeeding rectifier circuit (AC-to-DC converter) 15. Further, the output of the rectifier circuit 15 has a higher frequency component cut by the succeeding low-pass filter 16 and becomes a DC output proportional to the output of the band-pass filter 12.

Figure 6:
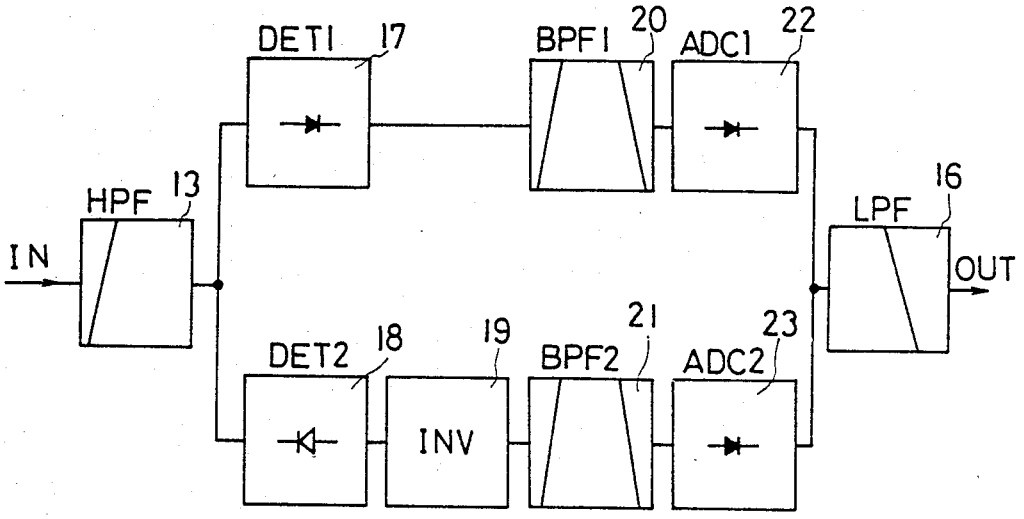

FIG. 6 shows an example of another circuit arrangement which executes the same operation. This circuit is such that the intermediate portion of the circuit of FIG. 5 has been modified. In this circuit, detection circuit 17 and 18 are not of the full-wave rectification type having the frequency multiplying action but are of the half-wave rectification type, so as to derive the positive side envelope by means of the detection circuit 17 and the negative side envelope by means of the detection circuit 18. The detected output on the negative side has its polarity inverted by an invertion circuit 19.

The respective detected outputs are applied to band-pass filters 20 and 21 and are rectified by rectifier circuits 22 and 23. Thereafter, the rectified outputs are combined and applied to a low-pass filter 16. The high-pass filter 13 at the input portion is unnecessary in principle, but it had better be disposed for the enhancement of the distinguishability. The detectors and rectifier circuits in FIGS. 4 to 6 should desirably be absolute value circuits or linear detection circuits in order to reduce operation errors due to nonlinearity.

In the next place, the input level deriving circuit 8 in FIG. 3 will be described. This circuit integrates or smooths the input signal as rectified and provides a DC voltage proportional to the input level.

The input sides of the input level deriving circuit 8 and the human-voice fundamental wave emphasizing and deriving circuit 9 are connected to the input terminal 1 together with the input side of the low-pass filter 3. The output sides of the input level deriving circuit 8 and the human-voice fundamental wave emphasizing and deriving circuit 9 are respectively connected to input terminals 10*a* and 10*b* of the arithmetic circuit 10.

The output signal of the input level deriving circuit 8 and the output signal of the human-voice fundamental wave emphasizing and deriving circuit 9 are weighted to appropriate levels. In addition, an appropriate weighting such as selection of the time constant of the integration circuit or the cutoff frequency of the smoothing low-pass filter is executed in the time axis region.

Using the appropriately weighted outputs, the arithmetic circuit 10 carries out relational operation of the output of the human-voice fundamental wave emphasizing and deriving circuit 9 and the output of the input level deriving circuit 8. In the following the arithmetic circuit 10 subtracts the former from the latter will be explained. In case where the input signal is the human voice, the output of the human-voice fundamental wave emphasizing and deriving circuit 9 becomes greater than that of the input level deriving circuit 8 owing to the appropriate weighting, and hence, a solution in the negative direction is provided as the output of the arithmetic circuit 10. In contrast, in case where the input signal is the music or any other sound, the output of the human-voice fundamental wave emphasizing and deriving circuit 9 becomes smaller than that of the input level deriving circuit 8, and hence, the solution of the arithmetic circuit 10 becomes the positive direction.

On the other hand, the input signal passes through the low-pass filter 3 (having the cutoff frequency of approximately 150 Hz) for deriving components effective for the body-felt vibrations and is applied to the voltage-controlled variable gain amplifier 4. Therefore, when the input signal is the human voice, the output of the voltage-controlled variable gain amplifier 4 is inhibited or weakened, whereas when the input signal is any other sound signal, the gain of the voltage-controlled variable gain amplifier 4 is increased to make the output great.

The voltage-controlled variable gain amplifier 4 can be replaced with a voltage-controlled variable frequency filter (VCF) as it is. It can also be replaced with a gate based on an analog switch, or the like. Since, however, the binary "on"-"off" switching in this case gives rise to an unnatural feeling, the gentle and continuous "on"-"off" control based on the analog increase and decrease by the voltage-controlled variable gain amplifier 4, etc. is more favorable after all.

In the above description, the human voices have referred only to the cases of voiced phones. Since unvoiced phones (consonants produced without the vibrations of the vocal cords) have their spectra in a higher frequency band, they are cut by the low-pass filter for deriving the body-felt vibration signal (having the cutoff frequency of approximately 150 Hz) and cause no problem (the low-pass filter 3 in FIG. 1 or FIG. 3).

Even in the cases of voiced phones, voices of high fundamental wave frequencies such as children's voices, female voices and high-pitched voices given forth in singing a song cause no problem for the same reason. It has been experimentally verified that the difference of the distinguishabilities based on different languages is scarely noted, which is thought to owe to the same reason.

Figure 7:
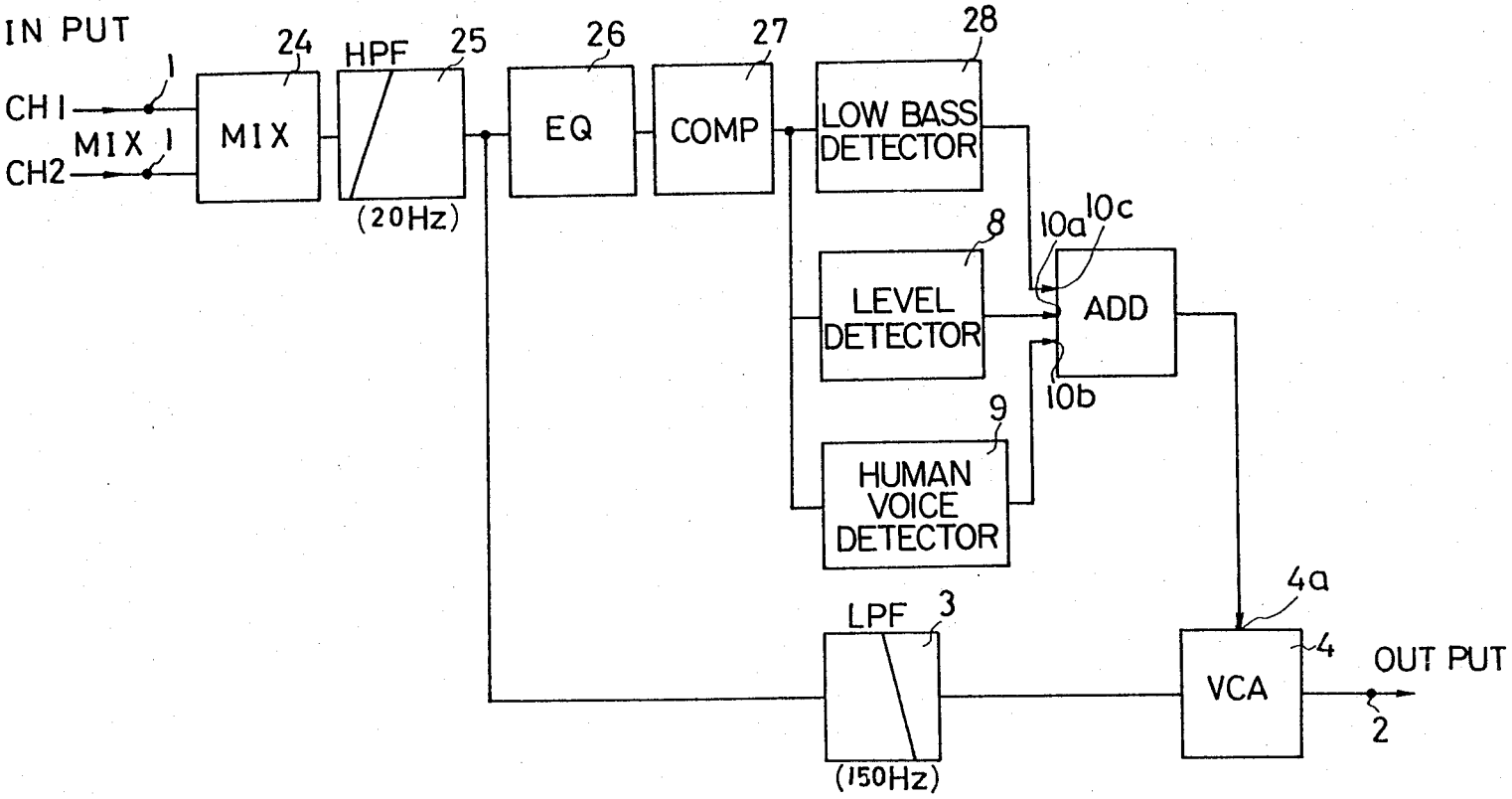
FIG. 7 is a block diagram showing another circuit arrangement according to the present invention.

Shown in FIG. 7 is block diagram of a practical circuit for performing this invention, in which the elements of both the circuits in FIGS. 1 and 3 are combined. In this case, two input terminals 1 are disposed so as to receive signals through two channels and to mix them by means of a mixer circuit 24. Connected on the output side of the mixer circuit 24 is a subsonic filter 25 for removing unnecessary subsonic waves of and below 20 Hz.

The output side of the subsonic filter 25 is branched into a circuit towards a voltage-controlled variable gain amplifier 4 through a low-pass filter 3 for deriving a body-felt vibration signal (having a cutoff frequency of 150 Hz) and a circuit towards an equalizer circuit 26. The equalizer circuit 26 gives the double-bass region and the high-pitched region appropriate equalizing curves in advance in order to enhance the human-voice distinguishability.

Connected at the stage succeeding to the equalizer circuit 26 is a level compressor circuit 27, on the output side of which the input ends of a double-bass region deriving circuit 28, an input level deriving circuit 8 and a human-voice fundamental wave emphasizing and deriving circuit 9 are connected. The output sides of these circuits 28, 8 and 9 are respectively connected to the input ends 10*c*, 10*a* and 10*b* of an arithmetic circuit 10.

The level compressor circuit 27 functions to compress the dynamic range of the input signal so as to prevent errors from developing in discrimination and operation (if the level is too low, the discrimination will be difficult, and if it is too high, an operational amplifier will be saturated). The double-bass sound region deriving circuit 28 is a circuit which detects a sound including double-bass sound components abundantly as is attended with an earth tremor and which corresponds to a part enclosed with a one-dot chain line in FIG. 1. The input level deriving circuit 8 and the human-voice fundamental wave emphasizing and deriving circuit 9 correspond to the circuits of the same numerals in FIG. 3, respectively.

In this arrangement, the arithmetic circuit 10 functions to carrying out relatinal operation of the output of the human-voice fundamental wave emphasizing and deriving circuit 9 and the sum between the output of the very double-bass sound region deriving circuit 28 and that of the input level deriving circuit 8. It is the same as in the case of FIG. 3 that the solution of the resultant difference is used to make the control of the voltage-controlled variable gain amplifier 4. When the weighting of the very low-pitched region deriving circuit 28 is made comparatively high and besides a dead band is set so as to prevent the circuit from responding to levels below a threshold value, good results are obtained.

What is claimed is:

1. The human voice signal discriminating system comprising:

means for providing an input signal which may contain human voice signals;

means for low-pass filtering said input signal to provide a filtered input signal having frequencies in a range of 0–150 Hz;

control means having an input terminal, output terminal, and control terminal, for receiving said filtered input signal at said input terminal and variably providing said filtered input signal at said output terminal in response to a control signal applied to said control terminal; and means for low-pass filtering said input signal to provide a control signal to said control terminal in response to frequencies in a range of 0–60 Hz in said input signal to cause said control means to pass said frequencies in said range of 0–150 Hz to said output terminal in response to said control signal resulting from frequencies in said 0–60 Hz range.

2. The system as claimed in claim 1, wherein said control means is a voltage-controlled variable gain amplifier which provides a variable gain in response to a voltage applied to the control terminal, said means for providing a control signal providing a variable voltage control signal in response to said detection of frequencies.

3. The system as claimed in claim 1, wherein said control means is a voltage-controlled variable frequency filter which varies its frequency in response to a voltage applied to the control terminal, said means for providing a control signal providing a variable voltage control signal in response to said detection of frequencies.

4. The system as claimed in claim 1, wherein said control means is an analog switch which provides or inhibits said input signal at its output terminal in response to a voltage applied to its control terminal, said means for providing a control signal providing a variable voltage control signal in response to said detection of frequencies.

5. The system as claimed in claims 1, 2, 3 or 4 further including first means for low pass filtering said input signal received by said means for providing, and second means for low pass filtering said input signal received by said input terminal, said first means having a cutoff for frequency less than said second means.

6. A system for discriminating a human voice signal comprising:

means for providing an input signal which may contain a human voice signal;

input level deriving circuit means coupled to receive said input signal for rectifying said input signal and smoothing said rectified signal to provide a direct current output proportional to a level of said input signal;

a human voice fundamental wave component level deriving circuit means coupled to receive said input signal and provide an output in response to the detection of a fundamental wave component of the human voice in said input signal;

arithmetic circuit means coupled to receive said outputs from said input level deriving circuit means and said fundamental wave component level deriving circuit means for subtracting one from the other to produce a difference output;

means for low-pass filtering said input signal to provide a filtered input signal having frequencies in a range of 0–150 Hz, and control means having a control terminal and coupled to receive said filtered input signal and provide a variable level output of said filtered input signal in response to a control signal applied to said control terminal, said difference output being coupled as the control signal applied to said control terminal.

7. The system as claimed in claim 6, wherein said control means is a voltage-controlled variable gain amplifier having a gain which varies in response to a voltage applied to said control terminal.

8. The system as claimed in claim 6, wherein said control means is a voltage-controlled variable frequency filter having a frequency which varies in response to a voltage applied to said control terminal.

9. The system as claimed in claim 6, wherein said control means is an analog switch which selectively provides or inhibits said control means output in response to a voltage applied to said control terminal.

10. The system as claimed in claims 6, 7, 8, or 9, further comprising low pass filter means for receiving said input signal and providing a low pass filtered output, said low pass filtered output being coupled to said arithmetic circuit means and summed with the outputs producing said difference output.

* * * * *